US008656566B1

(12) United States Patent
Chen

(10) Patent No.: US 8,656,566 B1
(45) Date of Patent: Feb. 25, 2014

(54) BUCKLE OF A SEAT BELT

(71) Applicant: Tung-Cheng Chen, Taichung (TW)

(72) Inventor: Tung-Cheng Chen, Taichung (TW)

( * ) Notice: Subject to any disclaimer, the term of this patent is extended or adjusted under 35 U.S.C. 154(b) by 0 days.

(21) Appl. No.: 13/671,855

(22) Filed: Nov. 8, 2012

(51) Int. Cl.
*A44B 11/26* (2006.01)

(52) U.S. Cl.
USPC ..... 24/631; 24/632; 24/642

(58) Field of Classification Search
USPC ..... 24/642, 648, 632, 650, 573.1, 647, 651, 24/637, 636, 643, 631
See application file for complete search history.

(56) References Cited

U.S. PATENT DOCUMENTS

| | | | | | |
|---|---|---|---|---|---|
| 4,385,425 | A * | 5/1983 | Tanaka et al. | ..... | 24/633 |
| 4,677,715 | A * | 7/1987 | Escaravage | ..... | 24/637 |
| 5,406,681 | A * | 4/1995 | Olson | ..... | 24/650 |
| 5,526,556 | A * | 6/1996 | Czank | ..... | 24/637 |
| 5,584,107 | A * | 12/1996 | Koyanagi et al. | ..... | 24/632 |
| 5,606,783 | A * | 3/1997 | Gillis et al. | ..... | 24/632 |
| 6,606,770 | B1 * | 8/2003 | Badrenas Buscart | ..... | 24/625 |
| 6,694,577 | B2 * | 2/2004 | Di Perrero | ..... | 24/642 |
| 6,868,591 | B2 * | 3/2005 | Dingman et al. | ..... | 24/615 |
| 7,159,285 | B2 * | 1/2007 | Karlsson | ..... | 24/650 |

* cited by examiner

*Primary Examiner* — Victor Batson
*Assistant Examiner* — Abigail Morrell
(74) *Attorney, Agent, or Firm* — C. G. Mersereau; Nikolai & Mersereau, P.A.

(57) ABSTRACT

A buckle of a seat belt has a seat belt buckle body, a releasing button module, a spring module, and a buckle module. The releasing button module is pivotally mounted in the seat belt buckle body and has a spring recess and an abutted portion. The spring module has a buckle spring mounted in the spring recess and a buckle spring block mounted on the buckle spring. The buckle module engages the releasing button module, and abuts the buckle spring block. When the releasing button module is pressed and the buckle module disengages from the releasing button module, the buckle spring will spring the buckle spring block, the buckle module will depart from the seat belt buckle body, and then the buckle spring block is stopped on the abutted portion. As a result, the buckle spring will not spring out of the seat belt buckle body.

2 Claims, 8 Drawing Sheets

BUCKLE OF A SEAT BELT

BACKGROUND OF THE INVENTION

1. Field of the Invention

The present invention relates to a buckle, and more particularly to a buckle of a seat belt.

2. Description of Related Art

With reference to FIGS. 7 and 8, the conventional buckle of a seat belt has a seat belt buckle body 60, a releasing button 70, two buckle springs 80, and a buckle module 90.

The releasing button 70 is pivotally mounted in the seat belt buckle body 60 and has two buckle spring recesses 71 formed in the releasing button 70. The buckle springs 80 are mounted in the buckle spring recesses 71 respectively. The buckle module 90 has a first buckle element 91 and a second buckle element 92. The first buckle element 91 and the second buckle element 92 are inserted in the seat belt buckle body 60. The second buckle element 92 engages the releasing button 70, and the first buckle element 91 abuts between the buckle springs 80 and the second buckle element 92.

When the releasing button 70 is pressed and disengages from the second buckle element 92, the buckle springs 80 will push the first buckle element 91, and then the buckle module 90 will spring out of the seat belt buckle body 60.

However, because the buckle springs 80 are not restricted at positions in the buckle spring recesses 71, the buckle springs 80 may spring out of the seat belt buckle body 60. Therefore, it is inconvenient for the use of the conventional buckle.

SUMMARY OF THE INVENTION

The main object of the present invention is to provide an improved buckle of a seat belt, which comprises a seat belt buckle body, a releasing button module, a spring module, and a buckle module.

The seat belt buckle body has an end, a side, a body space formed in the seat belt buckle body, a buckle opening formed in the end of the seat belt buckle body and communicating with the body space, and a button opening formed in the side of the seat belt buckle body and communicating with the body space.

The releasing button module is pivotally mounted in the body space, partially projects from the button opening, and has a spring recess formed in the releasing button module and facing the buckle opening, and an abutted portion mounted in the releasing button module and located between the spring recess and the buckle opening.

The spring module has a button spring mounted in the body space at a position opposite to the button opening and abutting between the seat belt buckle body and the releasing button module, a buckle spring mounted in the spring recess and an end of the buckle spring abutting on a bottom of the releasing button module, and a buckle spring block mounted on an end of the buckle spring at a position opposite to the bottom of the releasing button module and located between the buckle spring and the abutted portion.

The buckle module is inserted in the body space, engages the releasing button module, and abuts on the buckle spring block at a position opposite to the buckle spring.

The buckle spring springs the buckle spring block, and the buckle spring block will stop on the abutted portion, such that the buckle spring will not spring out of the spring space. As a result, it is convenient for use of the present invention.

Other objects, advantages, and novel features of the invention will become more apparent from the following detailed description when taken in conjunction with the accompanying drawing.

DETAILED DESCRIPTION OF PREFERRED EMBODIMENT

Figure 1:
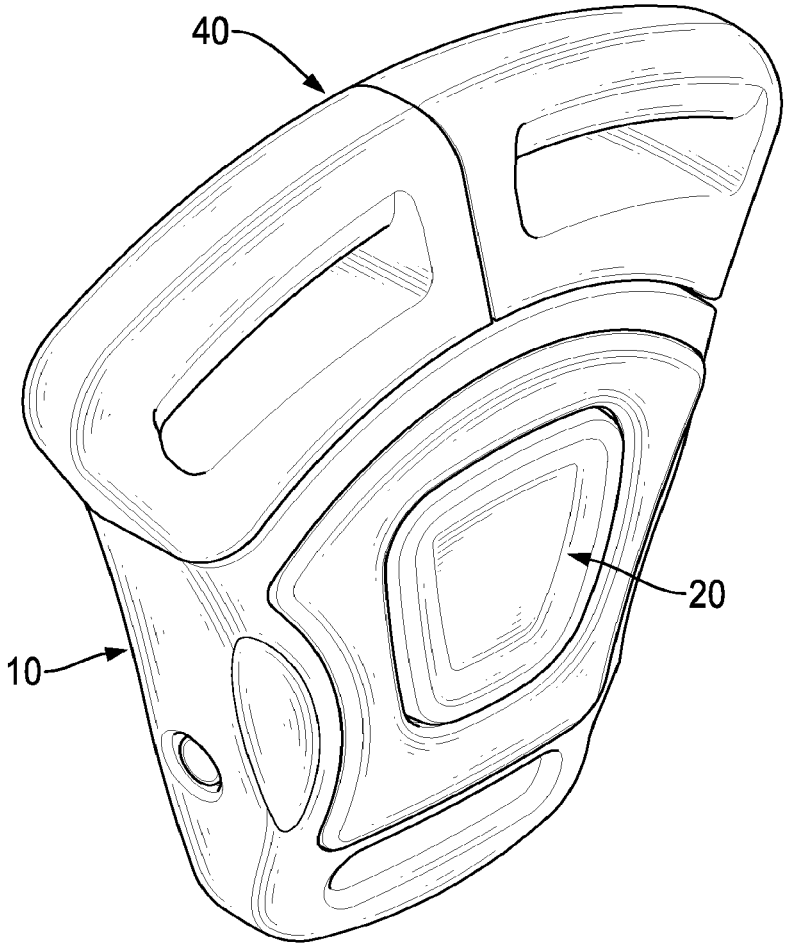
FIG. 1 is a perspective view of a buckle of a seat belt in accordance with the present invention.
Figure 2:
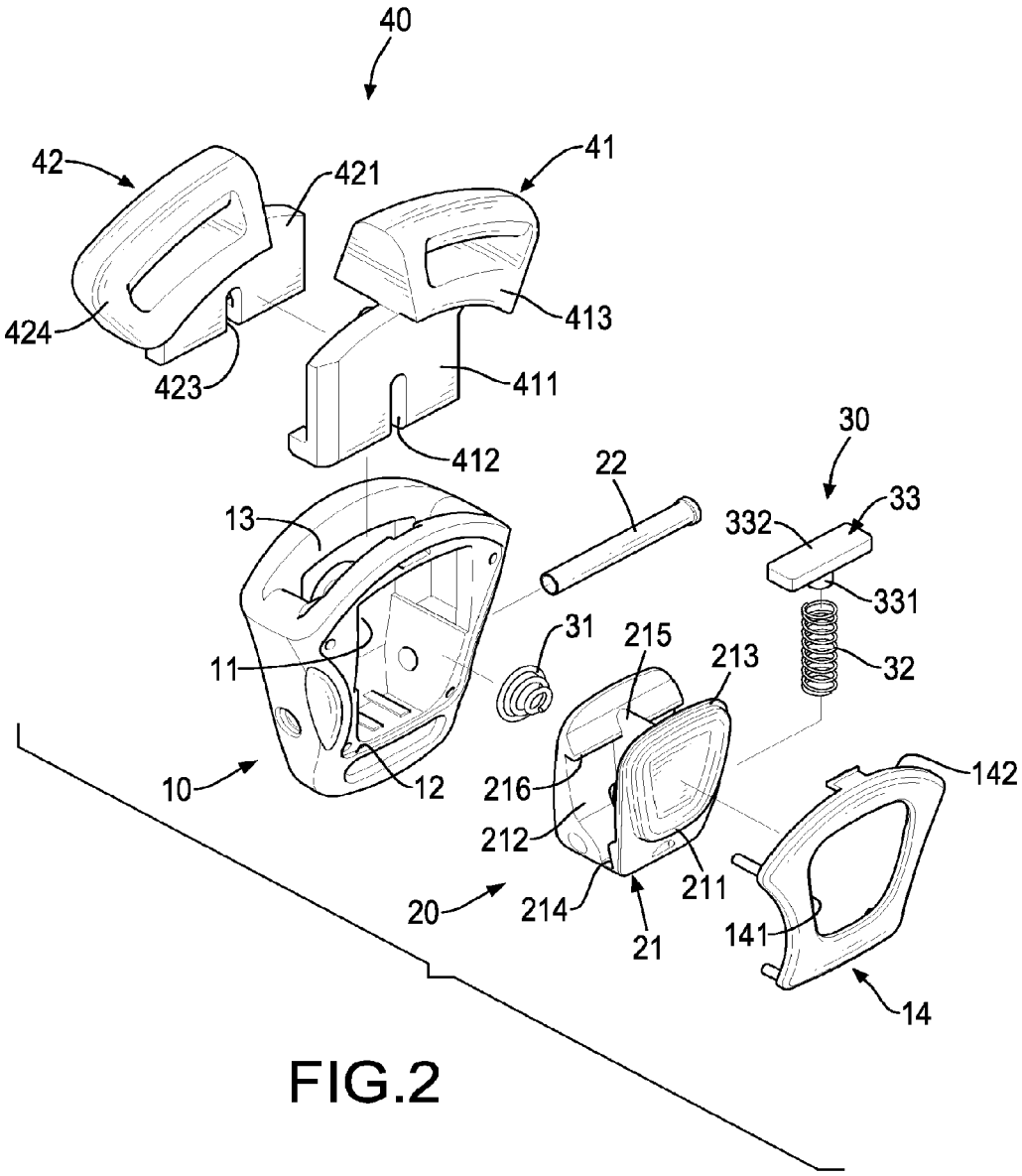
FIG. 2 is an exploded perspective view of the buckle in FIG. 1.

With reference to FIGS. 1 and 2, a preferred embodiment of a buckle of a seat belt in accordance with the present invention comprises a seat belt buckle body 10, a releasing button module 20, a spring module 30, and a buckle module 40.

Figure 3:
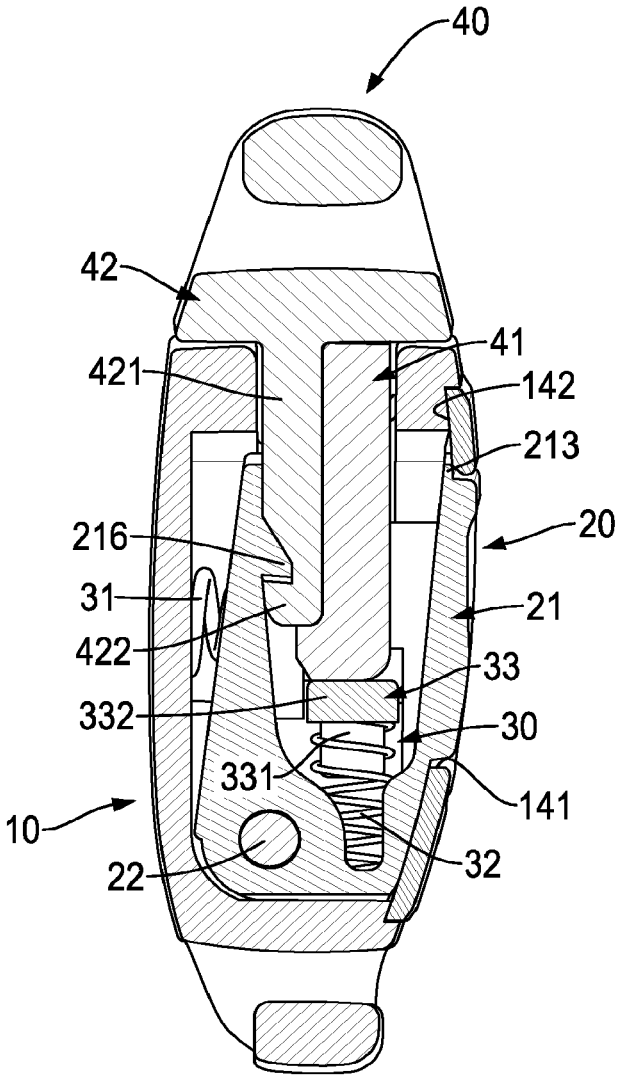
FIG. 3 is a side view in partial section of the buckle in FIG. 1.

With reference to FIGS. 2 and 3, the seat belt buckle body 10 can be connected with a seat belt and comprises a body space 11, a cover opening 12, a buckle opening 13, a bottom, and a button cover 14. The body space 11 is formed in the seat belt buckle body 10. The cover opening 12 is formed in a side of the seat belt buckle body 10 and communicates with the body space 11. The buckle opening 13 is formed in an end of the seat belt buckle body 10 and communicates with the body space 11. The bottom is opposite to the buckle opening 13 in position. The button cover 14 is mounted in the cover opening 12, is combined with the seat belt buckle body 10, and has a button opening 141 formed in a middle of the button cover 14, and an abutted surface 142 formed on a side of the button cover 14 at a position facing the body space 11 and being around the button opening 141.

Figure 4:
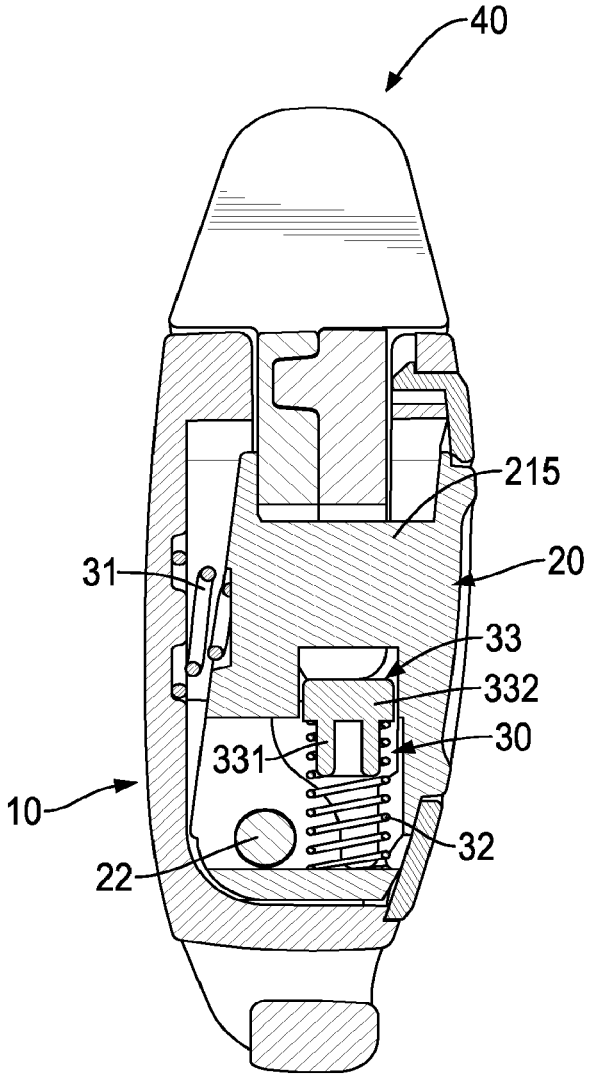
FIG. 4 is a cross sectional side view of the buckle in FIG. 1.

With reference to FIGS. 2 to 4, the releasing button module 20 is pivotally mounted in the body space 11 and part of the releasing button module 20 can protrude from the button opening 141. The releasing button module 20 comprises a button body 21 and a shaft 22. The button body 21 has a first plate 211, a second plate 212, an abutting surface 213, a bottom, a spring recess 214, an abutted portion 215, and a hooking portion 216. An end of the first plate 211 is connected with an end of the second plate 212, and the first plate 211 and the second plate 212 face each other to form a U-shaped cross-section of the button body 21. The abutting surface 213 is formed on a side of the first plate 211 of the button body 21 and can abut the abutted surface 142 of the button cover 14. The bottom of the button body 21 corresponds to the bottom of the seat belt buckle body 10 in position.

The spring recess 214 is formed in the bottom of the button body 21, communicates with the body space 11 and is located at a middle of the button body 21. The button body 21 may have two spring recesses 214. The abutted portion 215 is connected between the first plate 211 and the second plate 212. The hooking portion 216 protrudes from a side of the second plate 212 at a position facing the first plate 211. The shaft 22 is inserted in the bottom of the button body 21 and in the bottom of the seat belt buckle body 10 to pivotally connect the button body 21 with the seat belt buckle body 10.

Part of the spring module 30 is mounted in the body space 11 to abut the button body 21, and part of the spring module 30 is mounted in the releasing button module 20. The spring module 30 has a button spring 31, a buckle spring 32, and a buckle spring block 33. The button spring 31 is mounted in the body space 11, an end of the button spring 31 abuts the seat belt buckle body 10, and the other end of the button spring 31 abuts the second plate 212 of the button body 21. The button spring 31 can push the button body 21, and the abutting surface 213 of the button body 21 will abut the abutted surface 142 of the button cover 14. The buckle spring 32 is mounted in the spring recess 214, and an end of the buckle spring 32 abuts the bottom of the button body 21. The buckle spring block 33 is mounted between the buckle spring 32 and the abutted portion 215 and has a connected portion 331 and a block portion 332. The connected portion 331 is connected with an end of the buckle spring 32 at a position opposite to the bottom of the button body 21. The block portion 332 is elongated, is connected with a top of the connected portion 331 and can abut the abutted portion 215 with a force provided by the buckle spring 32. The block portion 332 has a middle segment 333 corresponding to and selectively abutting the abutting portion 215 at that position.

The buckle spring block 33 may have two connected portions 331 if the spring module 30 has two buckle springs 32. The connected portion 331 may be omitted if the buckle spring 32 is mounted in a recess defined in the buckle spring block 33. The shape of the buckle spring block 33 is not restricted in the present invention, as long as the buckle spring 32 can be connected with the buckle spring block 33 and the buckle spring block 33 can abut the abutted portion 215 by the force of the buckle spring 32.

Figure 5:
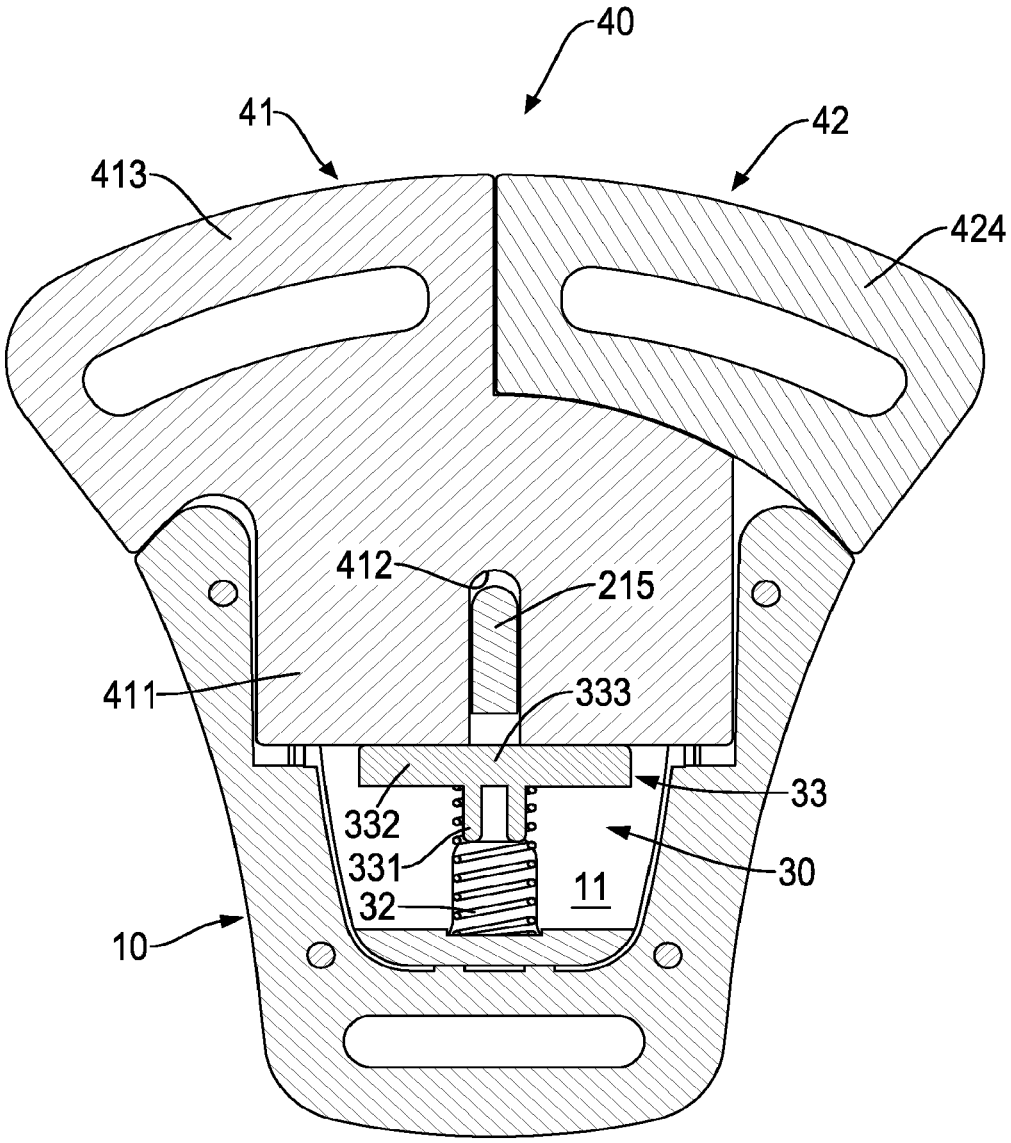
FIG. 5 is a cross sectional front view of the buckle in FIG. 1.

With reference to FIGS. 3 to 5, the buckle module 40 is inserted in the body space 11 and engages the releasing button module 20, and part of the buckle module 40 protrudes from the buckle opening 13. The buckle module 40 has a first buckle element 41 and a second buckle element 42. The first buckle element 41 can abut the buckle spring block 33 and has an inserting plate 411, a positioning slot 412, and a buckle portion 413. The inserting plate 411 is inserted in the body space 11 and has two ends. One of the ends of the inserting plate 411 is hooked and abuts the buckle spring block 33. The positioning slot 412 is formed in the inserting plate 411 and accommodates part of the abutted portion 215. The buckle portion 413 is connected with the other end of the inserting plate 411 at a position opposite to the end of the inserting plate 411 abutting the buckle spring block 33 and protrudes from the buckle opening 13. The buckle portion 413 can be connected with a seat belt.

The second buckle element 42 can abut the first buckle element 41 and has an inserting plate 421, a hooking portion 422, a positioning slot 423, and a buckle portion 424. The inserting plate 421 of the second buckle element 42 is inserted in the body space 11 and has two ends. One of the ends of the inserting plate 421 of the second buckle element 42 presses the end of the inserting plate 411 of the first buckle element 41 abutting the buckle spring block 33. The hooking portion 422 is formed on a side of the inserting plate 421 of the second buckle element 42 at a position opposite to the inserting plate 411 of the first buckle element 41, and the hooking portion 422 of the second buckle element 42 engages the hooking portion 216 of the button body 21. The positioning slot 423 is formed in the inserting plate 421 and the hooking portion 422 of the second buckle element 42 and is corresponding to the positioning slot 412 of the first buckle element 41. The positioning slot 423 of the second buckle element 42 accommodates part of the abutted portion 215. The buckle portion 424 of the second buckle element 42 is connected with an end of the inserting plate 421 at a position opposite to the hooking portion 422 of the second buckle element 42 and projects from the buckle opening 13. The buckle portion 424 of the second buckle element 42 can be connected with a seat belt.

Figure 6:
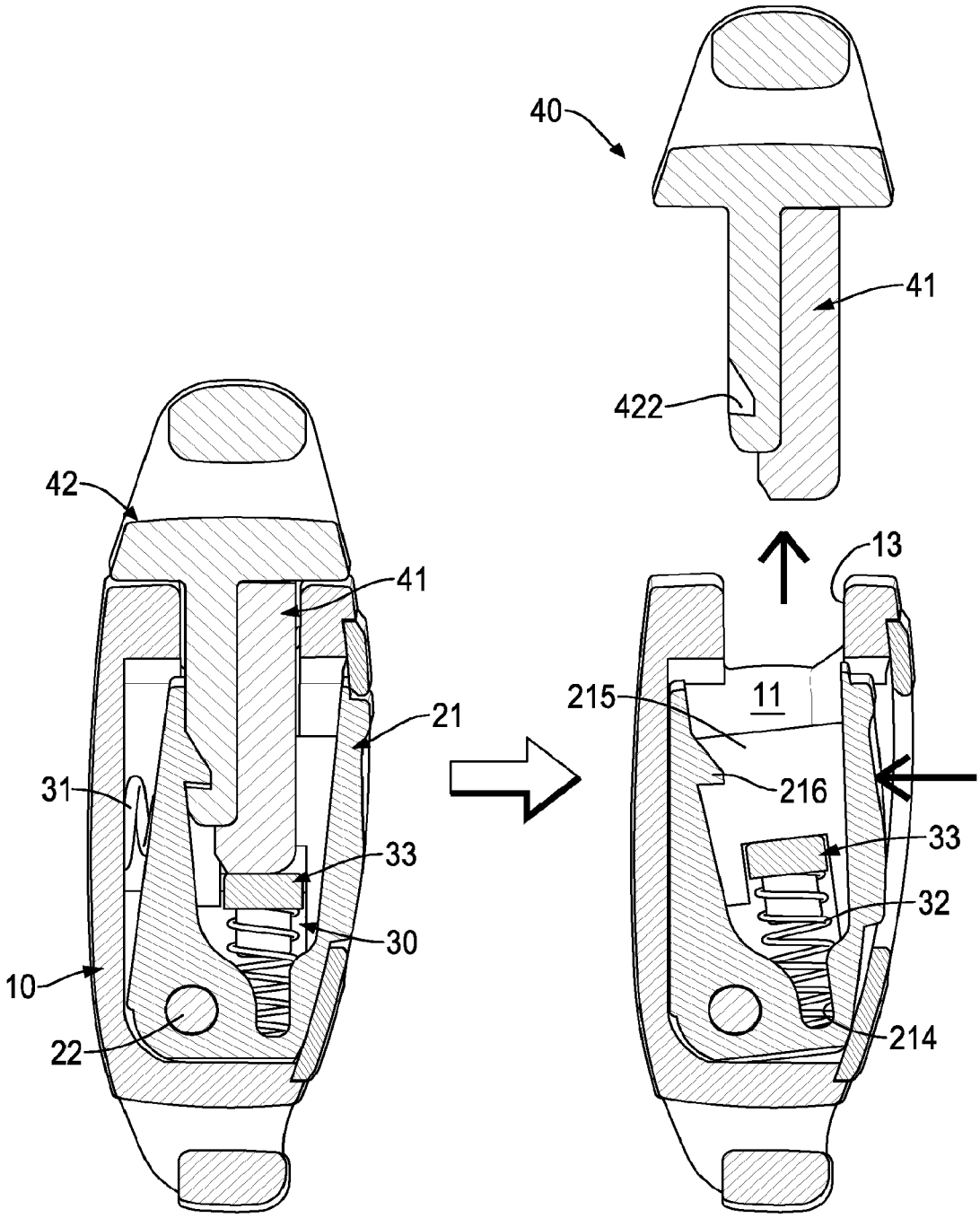
FIG. 6 is operational side views in partial section of the buckle in FIG. 1.
Figure 7:
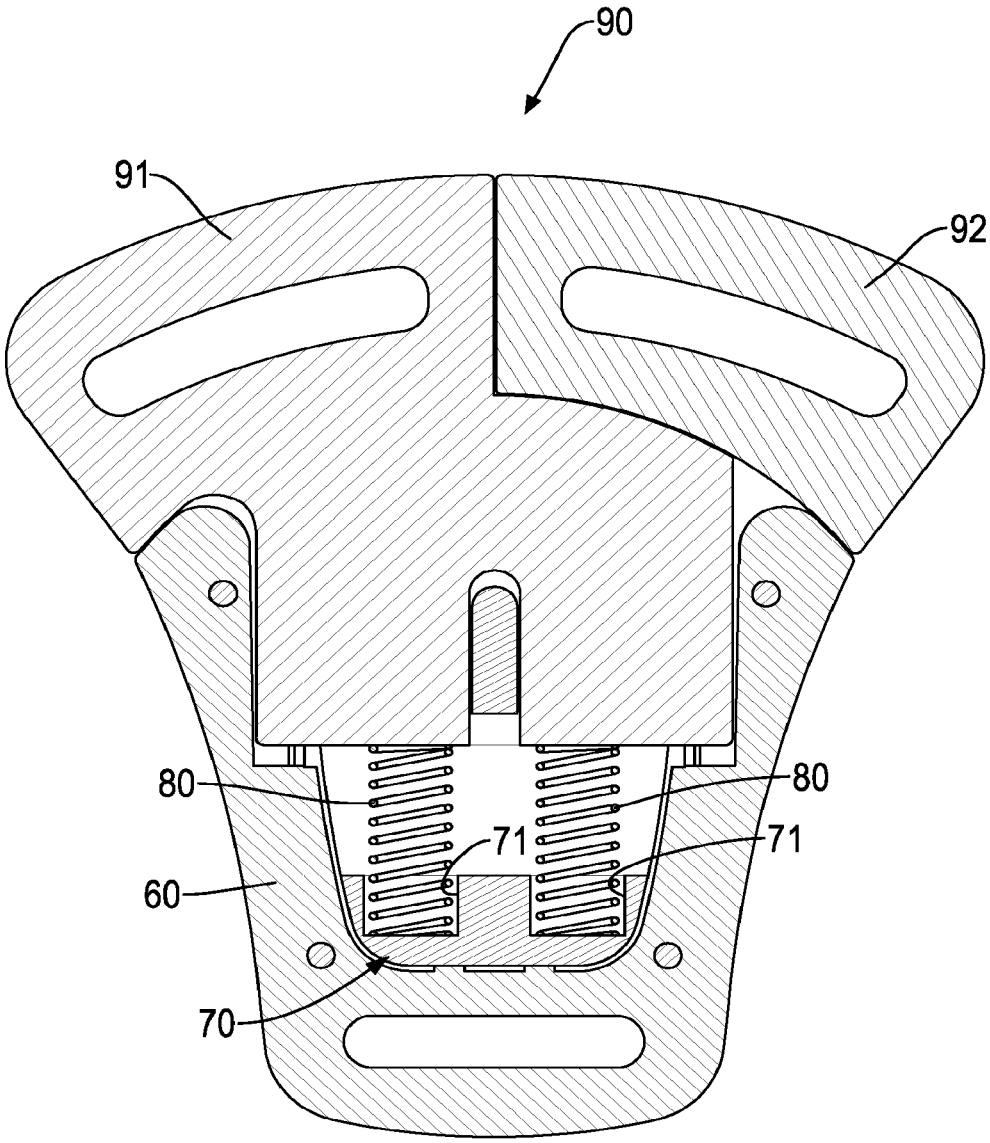
FIG.7 PRIOR ART
FIG. 7 is a cross sectional front view of a conventional buckle of a seat belt.
Figure 8:
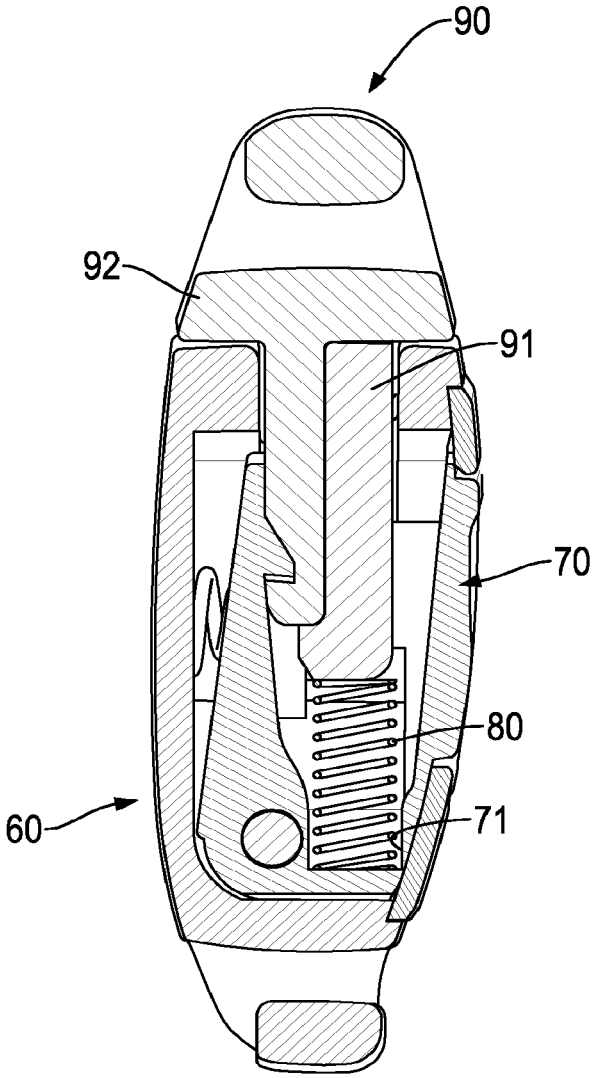
FIG.8 PRIOR ART
FIG. 8 is a cross sectional side view of the conventional buckle in FIG. 7.

With reference to FIG. 6, the button body 21 is pivotally combined with the seat belt buckle body 10 by the shaft 22, the button spring 31 pushes the button body 21 to let the button body 21 engage the second buckle element 42 firmly, the second buckle element 42 presses on the first buckle element 41, and the first buckle element 41 presses the buckle spring block 33. When the button body 21 is pressed to make the button body 21 pivot on the shaft 22 relative to the seat belt buckle body 10, the button body 21 will compress the button spring 31 and the hooking portion 216 of the button body 21 will disengage from the hooking portion 422 of the second buckle element 42. The buckle spring block 33 will be sprung by the buckle spring 32, and then the buckle spring block 33 will spring the first buckle element 41. The buckle module 40 will depart from the body space 11 through the buckle opening 13.

The buckle spring block 33 will abut on the abutted portion 215 when the buckle spring block 33 is sprung by the buckle spring 32. The buckle spring 32 will not spring out of the spring recess 214, such that it is convenient for the use of the present invention. The buckle spring block 33 also spreads the force of the buckle spring 32 for pushing the buckle module 40 equally, such that the spring module 30 will spring the buckle module 40 stably.

What is claimed is:

1. A buckle of a seat belt comprising:

a seat belt buckle body having
- an end;
- a side;
- a body space formed in the seat belt buckle body;
- a buckle opening formed in the end of the seat belt buckle body and communicating with the body space; and
- a button opening formed in the side of the seat belt buckle body and communicating with the body space;

a releasing button module pivotally mounted in the body space, partially projecting from the button opening and having
- a spring recess formed in the releasing button module and facing the buckle opening;
- an abutted portion mounted in the releasing button module and located between the spring recess and the buckle opening; and
- a hooking portion protruding from the releasing button module;

a spring module having
- a button spring mounted in the body space at a position opposite to the button opening and abutting between the seat belt buckle body and the releasing button module;
- a buckle spring mounted in the spring recess and an end of the buckle spring abutting on a bottom of the releasing button module; and
- a buckle spring block mounted on an end of the buckle spring at a position opposite to the bottom of the releasing button module, and located between the buckle spring and the abutted portion; and a buckle module inserted in the body space, engaging the releasing button module, and abutting on the buckle spring block at a position opposite to the buckle spring, wherein the buckle spring block has an elongated block portion abutting on the buckle module and having a middle segment corresponding to and selectively abutting the abutted portion at that position; and the buckle module comprises a first buckle element selectively abutting the buckle spring block and having an inserting plate inserted in the body space and having a hooked end abutting the buckle spring block; and a positioning slot is formed in the hooked end of the inserting plate and accommodating a part of the abutted portion; and a second buckle element selectively abutting the first buckle element and having an inserting plate inserted in the body space;

a hooking portion formed on a side of the inserting plate of the second buckle element at a position opposite to the inserting plate of the first buckle element and engaging the hooking portion of the releasing button module; and a positioning slot formed in the inserting plate and the hooking portion of the second buckle element and accommodating a part of the abutted portion.

2. The buckle of a seat belt as claimed in claim 1, wherein the buckle spring block has a connected portion protruding on a side of the elongated block portion at a position opposite to the buckle module and connected with the buckle spring.

* * * * *